US006774703B2

(12) United States Patent
Mihara

(10) Patent No.: US 6,774,703 B2
(45) Date of Patent: Aug. 10, 2004

(54) SEMICONDUCTOR DEVICE

(75) Inventor: Masaaki Mihara, Tokyo (JP)

(73) Assignee: Renesas Technology Corp., Tokyo (JP)

( * ) Notice: Subject to any disclaimer, the term of this patent is extended or adjusted under 35 U.S.C. 154(b) by 0 days.

(21) Appl. No.: 10/216,730

(22) Filed: Aug. 13, 2002

(65) Prior Publication Data

US 2003/0112057 A1 Jun. 19, 2003

(30) Foreign Application Priority Data

Sep. 14, 2001 (JP) ..... 2001-279528

(51) Int. Cl.[7] ..... G05F 3/02
(52) U.S. Cl. ..... 327/530; 327/334
(58) Field of Search ..... 327/99, 407, 408, 327/409, 530, 334

(56) References Cited

U.S. PATENT DOCUMENTS 4,366,470 A * 12/1982 Takanashi et al. ..... 341/136
4,403,113 A * 9/1983 Ogita ..... 327/98
4,404,430 A * 9/1983 Ogita ..... 327/98
5,168,177 A * 12/1992 Shankar et al. ..... 326/37
5,204,559 A * 4/1993 Deyhimy et al. ..... 327/232
5,712,568 A * 1/1998 Flohr et al. ..... 324/434
5,825,781 A * 10/1998 Gadsby et al. ..... 370/525
5,864,258 A * 1/1999 Cusinato et al. ..... 331/34
6,075,477 A * 6/2000 Kokubun et al. ..... 341/154
6,281,716 B1 8/2001 Mihara
6,473,020 B2 * 10/2002 Tsukamoto ..... 341/154

FOREIGN PATENT DOCUMENTS

JP 1-117427 5/1989
JP 2000-19200 1/2000

* cited by examiner

*Primary Examiner*—Terry D. Cunningham
(74) *Attorney, Agent, or Firm*—McDermott Will & Emery LLP

(57) ABSTRACT

Even in the case where the reference voltage of a reference-voltage generating circuit is adjusted by fuses, a number of fuses are required to be disconnected, and the area of fuse circuits tends to increase for fine adjustment. Therefore, by dividing control signals into one part that are predetermined by fixed wiring and another part that is adjustable by fuse circuits, time required for disconnecting fuses is minimized and fine adjustment is made possible.

2 Claims, 9 Drawing Sheets

SEMICONDUCTOR DEVICE

BACKGROUND OF THE INVENTION

1. Field of the Invention

The present invention relates to a circuit that sets, at a constant value, the voltage, signals and so on that are used in a semiconductor device.

2. Description of the Related Art

In semiconductor devices having a reference-voltage generating circuit that generates a reference voltage, the reference voltage generally shows some dispersion due to manufacturing conditions of the semiconductor devices and individual semiconductor devices or chips. Therefore, the reference-voltage generating circuit has been equipped with a control circuit that controls the reference voltage using fuses or the like. Such a reference-voltage generating circuit is disclosed, for example, in Japanese Laid-open Patent Publication H1-117427 and is illustrated in FIG. 9.

In FIG. 9, reference numeral 93 is a control circuit that generates control signals S0 through S3, which are trimming output, depending on whether fuses are disconnected or not. Reference numeral 94 is a voltage divider circuit that selects, depending on the control signals S0 through S3, one of a plurality of voltages that are obtained by voltage division between two reference potentials VA and VB and that outputs the selected voltage to a node 51 as a reference voltage. Reference numeral 92 is a buffer circuit, which drives a load connected to its output terminal OUT so that the load voltage can become equal to the reference voltage input to the input terminal IN.

Further, a voltage divider circuit 94 consists of a divided-voltage generating circuit 194 and a selecting circuit 195. The divided-voltage generating circuit 194 consists of $2^{N-1}$ resistors Rj, where j=1, . . . , 15, connected in series between two reference electric potentials VA and VB and outputs divided voltages to nodes 1 through 16. The selecting circuit 195 receives output voltages from the divided-voltage generating circuit 194 and the control signals S0 through S3 and selects one of the divided voltages depending on the control signals that is to be outputted to the node 51 as a reference signal.

The selecting circuit 195 is composed of N-channel MOSFETs Q1 through Q16, Q101 through 108, Q111 through Q114, and Q121 and Q122, and buffers G01 through G04 that have complementary outputs so that the reference voltage can be determined by the control signals S0 through S3 with the closest voltages being distinguished by the Hamming code distance 1. The relationship between the control signals and the reference voltage at the node 51 is shown in Table 1.

In Table 1, 1 and 0 respectively represent a high level signal and a low level signal. The same applies hereinafter unless mentioned otherwise.

TABLE 1

| Control signals | | | | Voltage |
|---|---|---|---|---|
| S3 | S2 | S1 | S0 | at node 51 |
| 1 | 1 | 1 | 0 | $0/15(V_A-V_B)$ |
| 1 | 1 | 0 | 0 | $1/15(V_A-V_B)$ |
| 1 | 0 | 0 | 0 | $2/15(V_A-V_B)$ |
| 1 | 0 | 1 | 0 | $3/15(V_A-V_B)$ |
| 0 | 0 | 1 | 0 | $4/15(V_A-V_B)$ |

TABLE 1-continued

| Control signals | | | | Voltage |
|---|---|---|---|---|
| S3 | S2 | S1 | S0 | at node 51 |
| 0 | 0 | 0 | 0 | $5/15(V_A-V_B)$ |
| 0 | 1 | 0 | 0 | $6/15(V_A-V_B)$ |
| 0 | 1 | 1 | 0 | $7/15(V_A-V_B)$ |
| 0 | 1 | 1 | 1 | $8/15(V_A-V_B)$ |
| 0 | 1 | 0 | 1 | $9/15(V_A-V_B)$ |
| 0 | 0 | 0 | 1 | $10/15(V_A-V_B)$ |
| 0 | 0 | 1 | 1 | $11/15(V_A-V_B)$ |
| 1 | 0 | 1 | 1 | $12/15(V_A-V_B)$ |
| 1 | 0 | 0 | 1 | $13/15(V_A-V_B)$ |
| 1 | 1 | 0 | 1 | $14/15(V_A-V_B)$ |
| 1 | 1 | 1 | 1 | $15/15(V_A-V_B)$ |

The control signals S1, S2, S3, and S0 can respectively adjust voltage by units of $1/15(V_A-V_B)$, $2/15(V_A-V_B)$, $4/15(V_A-V_B)$ and $8/15(V_A-V_B)$. Also, in the code comprising the set of the combinations of the values of the control signals S0 through S3, the Hamming distance between neighboring code words is 1. Therefore, the upper bits, which are the values of the control signals S3 and S2, are first determined by disconnecting fuses in order to determine a range of rough values of the reference voltage through a first measurement of the semiconductor device. Then, the value of the reference voltage can be determined by the lower bits, which are the values of the control signals S1 and S0, within a constant range through a second measurement of the semiconductor device.

More specifically, if the values of the control signals S3 and S2 are determined respectively as 0 and 1 by a first measurement, then the voltage between $6/15(V_A-V_B)$, $9/15(V_A-V_B)$ can be set by the control signals S1 and S0 through a second measurement.

We have shown control signals of 4 bits as a prior example. However, demands for adjustment of minute voltage values have increased in recent years. Therefore, there is a tendency for the control signals to be many bits through many trimming outputs. As a result, the places for fuse adjustment are increasing. Therefore, it requires much time to disconnect many fuses.

Further, an increase in the number of bits, which is the number of signal lines, brings an increase in the area of fuse circuits.

SUMMARY OF THE INVENTION

The object of the present invention is thus to solve the above problems and to reduce time for disconnecting fuses and the fuse circuit area.

To achieve the above object, the present invention provides a semiconductor device equipped with a control circuit that is connected to wiring lines that supply a predetermined voltage and outputs a first control signal depending on the predetermined voltage and a second control signal that can be set depending on whether a fuse is disconnected or not, a divided-voltage generating circuit that is connected between predetermined first and second potential points and outputs voltages between the two potentials, and a selecting circuit that selects as a reference voltage one of the voltages output from the divided-voltage generating circuit, depending on the control signals.

A semiconductor device in accordance with the present invention is equipped with a control circuit that is connected to wiring lines that supply a predetermined voltage and outputs a first control signal depending on the predetermined voltage and a second control signal that can be set depending on whether a fuse is disconnected or not. Therefore, the number of fuses can be reduced.

Preferably, the selecting circuit is constructed so that the Hamming distance between any code words of the control signals can be 1 for the two closest voltages and thereby continuous selection of voltage can be possible.

The selecting circuit may be constructed so that the code represented by the control signals can be the binary-coded decimal code. If constructed in this way, continuous selection of voltage within a constant range can be possible.

In a preferred embodiment, the control signals in the control circuit consist of a group of lower bits that can adjust minute voltage and a group of upper bits that can control voltage greater than the one that the group of lower bits can adjust. Then the second control signal may be the lower bit group to control fine adjustment of voltage with fuse circuits. In another method, the control signals of the control circuit also consist of a group of lower bits that can adjust minute voltage and a group of upper bits that can control voltages greater than the one that the group of lower bits can adjust. Then a first control signal may be one bit of the lower bit group and a second control signal may be one bit of the upper bit group.

The semiconductor device of the present invention may be equipped with fuse circuits that vary complementary first and second output signals depending on whether fuses are disconnected or not. In this case, if a constant voltage is at a central value, then the disconnection of fuses can be reduced at that central point.

The divided-voltage generating circuit described above may contain resistors of different resistances with constant ratios, and the resistors may be connected in series and the connections between them may be output terminals. In this case, the number of resistors and fuses may be reduced.

Further, a resistance means may be installed between the above divided-voltage generating circuit and the first or second potential point. In this case, a small amount of voltage can be given to the divided-voltage generating circuit, so that fine adjustment of voltage is made easy.

It is also preferable that the semiconductor circuit of the present invention has a voltage-control oscillator circuit that inputs a reference voltage to an oscillator circuit to control the oscillation frequency. By this means, the oscillation frequency can be controlled by a small number of fuses.

BRIEF DESCRIPTION OF THE DRAWINGS

The present invention will become readily understood from the following description of preferred embodiments thereof made with reference to the accompanying drawings, in which like parts are designated by like reference numerals and in which.

DESCRIPTION OF THE PREFERRED EMBODIMENTS

First Embodiment.

Figure 1:
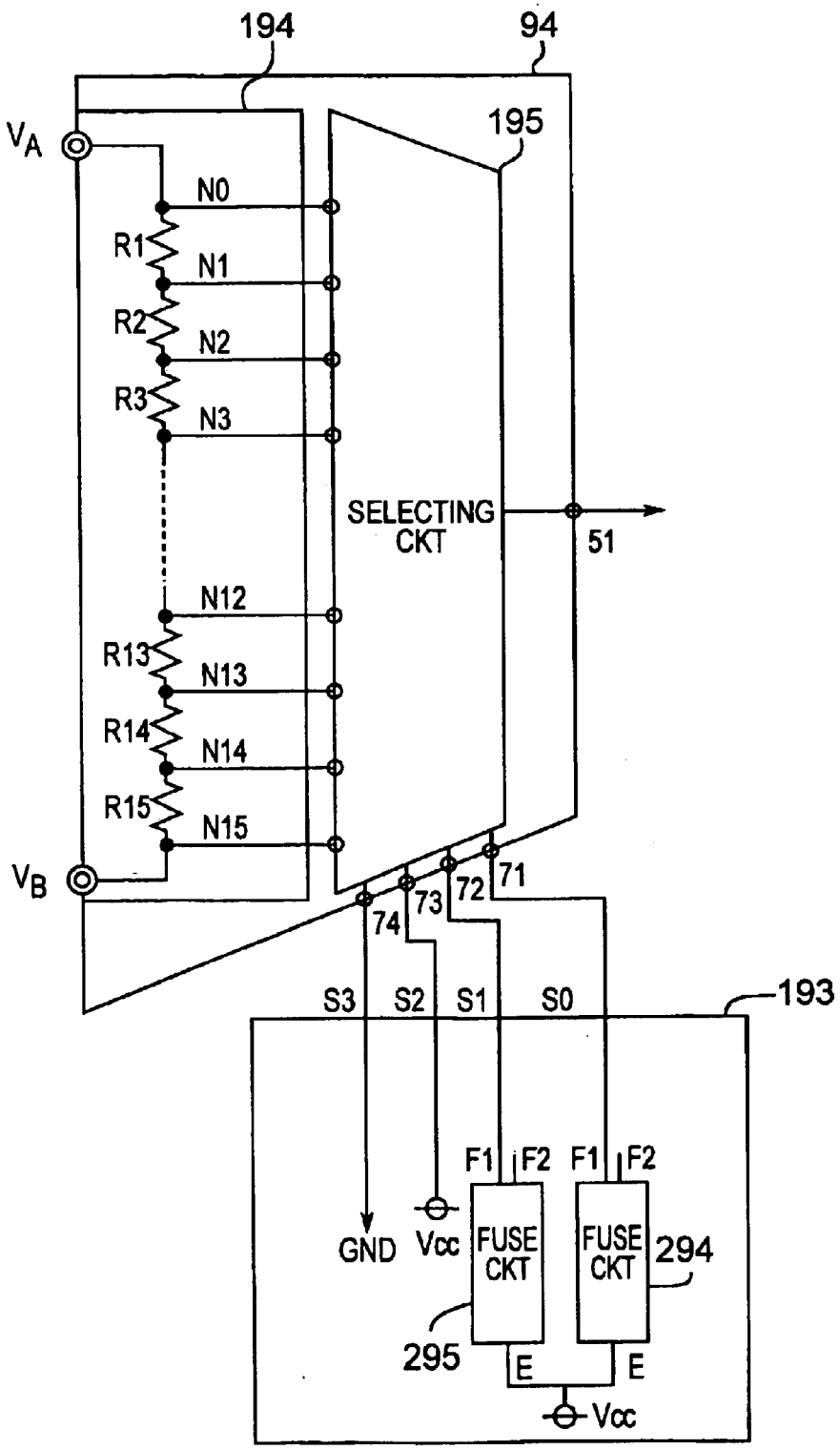
FIG. 1 illustrates a reference-voltage generating circuit in a first embodiment of the present invention.

FIG. 1 illustrates a reference-voltage generating circuit in a first embodiment. For ease of description, we will show an example such that control signals consist of 4 bits.

In FIG. 1, 193 is a control circuit that can set the values of control signals S0 through S3 and outputs the control signals. 94 is a voltage divider circuit that selects one of a plurality voltages, which are between two reference potentials VA and VB, depending on the control signals S0 through S3 to output the selected voltage as a reference voltage Vout.

Next, looking at the construction of control circuit 193, one group of its components consists of the signal lines of the control signals S3, S2, and the like that are connected to the GND or Vcc power supply line, and another group consists of signal lines of the control signals S1, S0, and the like that are connected to fuse circuits 294 and 295. Therefore, the values of the control signals S3 and S2 become fixed by the power supply lines, while the values of the control signals S1 and S0 can be set depending on whether corresponding fuses are disconnected or not.

Figure 2:
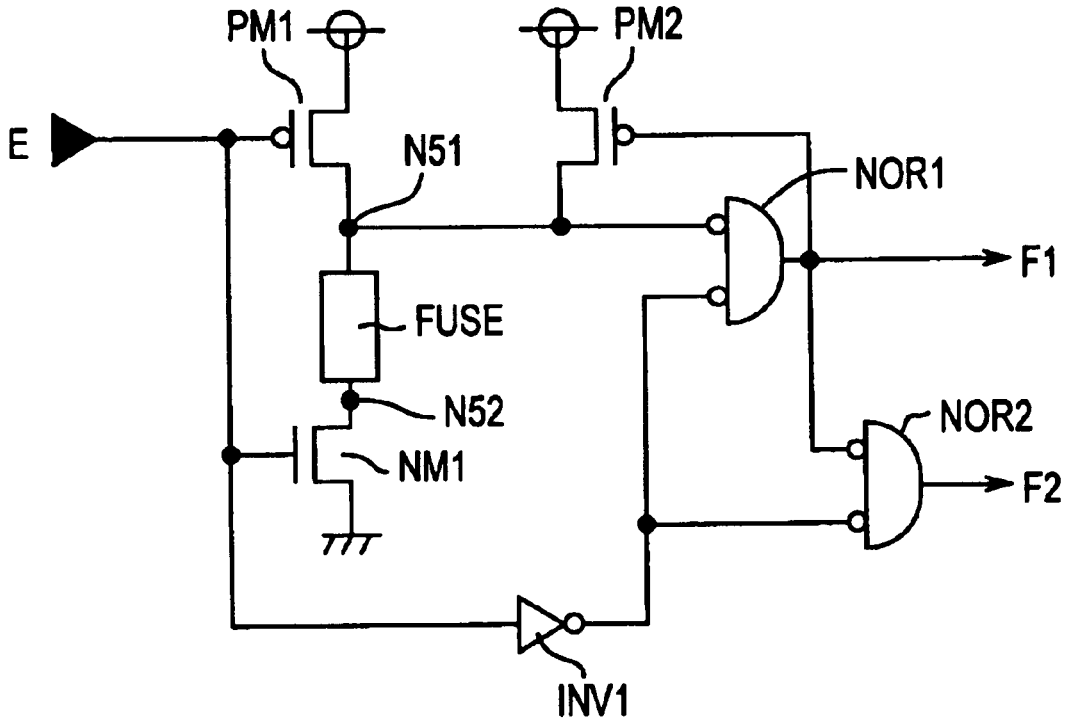
FIG. 2 illustrates a fuse circuit in the first embodiment of the present invention.

FIG. 2 illustrates a concrete circuit of the fuse circuit 294 in FIG. 1. The fuse circuit 295 is similar. In FIG. 2, PM1 and PM2 are p-type MOS transistors, and NM1 is an n-type MOS transistor. A fuse is placed between nodes N51 and N52. NOR1 and NOR2 are NOR gates, and INV1 is an inverter. The fuse is usually a wire composed of a film containing poly-silicon or a metal film of aluminum or the like. It can be disconnected with a laser cutter. When disconnected, it becomes electrically nonconductive.

A signal E is an activation signal that controls the activation of fuse circuit 294. Output signals F1 and F2 are the output signals of fuse circuit 294, and their values change depending on whether the fuse is disconnected or not. When fuse circuit 294 is activated, the values of F1 and F2 become complementary.

Table 2 shows the relationships between the activation signal E and the output signals F1 and F2 in fuse circuit 294.

TABLE 2

| | | E = 1 | |
|---|---|---|---|
| | E = 0 | Fuse disconnected | Fuse Connected |
| F1 | 0 | 0 | 1 |
| F2 | 0 | 1 | 0 |

When the activation signal E is at 0, the output signals F1 and F2 are both at 0. When the activation signal E is at 1 and the fuse is disconnected, the output signal F1 becomes 0 and the output signal F2 becomes 1. When the activation signal E is at 1 and the fuse is connected, the output signal F1 becomes 1 and the output signal F2 becomes 0. In this way, fuse circuit 294 can vary the values of the output signals depending on whether the fuse is disconnected or not.

In FIG. 1, the activation signals E are at 1 for the two fuse circuits 294 and 295, and their output signals F1 are respectively used as control signals S0 and S1.

Next, looking at the construction of the voltage divider circuit 94, it consists of divided-voltage generating circuit 194 that has $2^{N-1}$ resistors Rj, j=1, . . . , 15 connected in series between two reference voltages and outputs the divided voltages to nodes Nj, (j=1, . . . , 15), and a selecting circuit 195 that receives the output voltages of the divided-voltage generating circuit 194 and the control signals S0 through S3 and selects one of the divided voltages depending on the values of the control signals.

Figure 3:
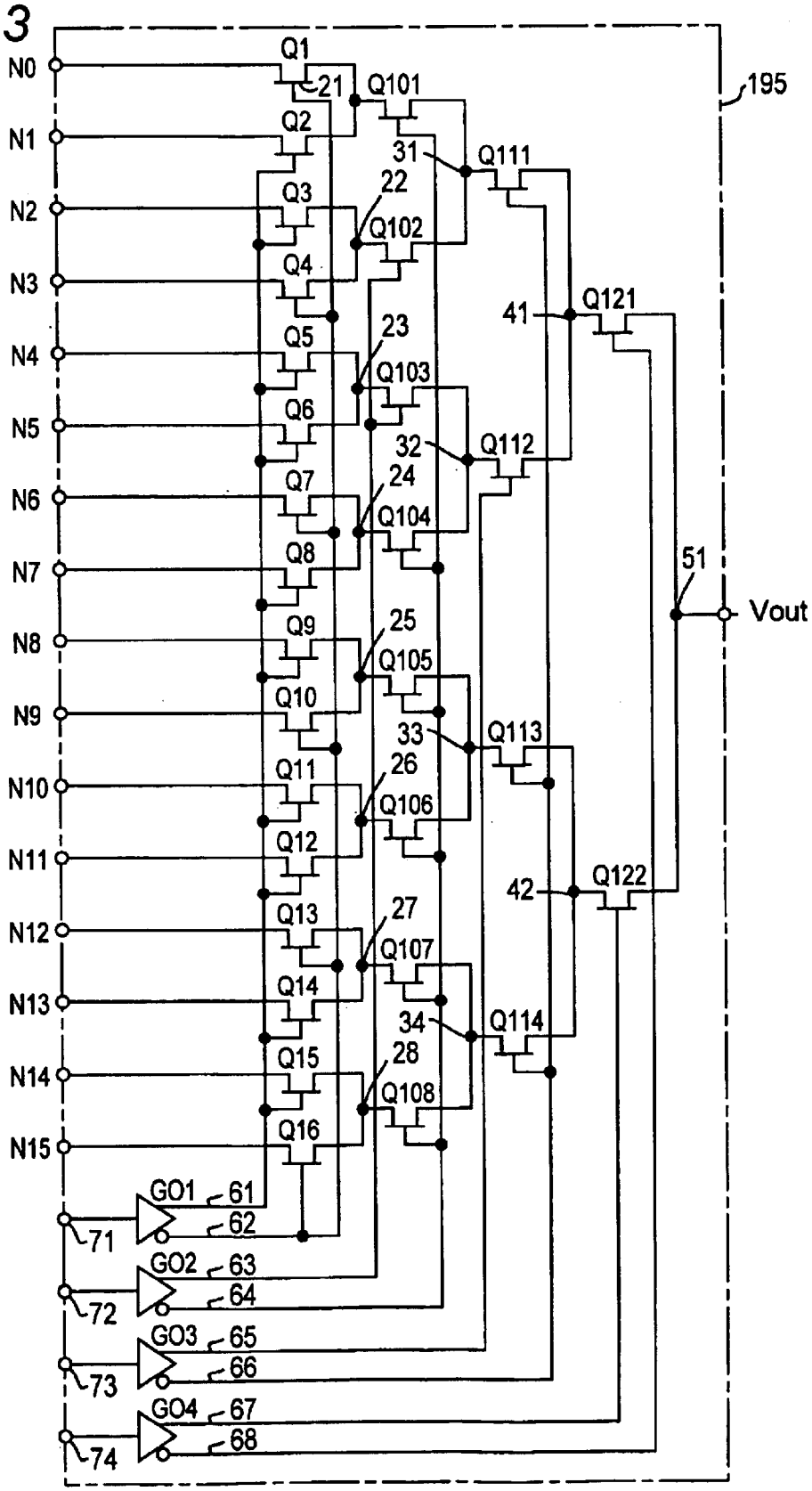
FIG. 3 illustrates a selecting circuit in the first embodiment.

The selecting circuit here receives the control signals S0 through S3 as a code word for a voltage, which is distinguished from a code word for the closest voltages by the Hamming distance 1. FIG. 3 illustrates a concrete circuit diagram. It is composed of n-channel MOS transistors, Q1 through Q16, Q101 through Q108, Q111 through Q114, and Q121 and Q122, and buffers G01 through G04 having complementary outputs. ON and OFF of these n-channel MOSFETs are determined by the control signals input to nodes 71 through 74, and one of the voltage at the nodes N0 through N15 is output to node 51. Table 3 shows the relationship between the values of the control signals S0 through S3 and the voltage at node 51, which becomes a reference voltage.

TABLE 3

| Hamming distance 1 | | | | | |
|---|---|---|---|---|---|
| | Control signals | | | | Reference Voltage |
| Node | S3 | S2 | S1 | S0 | Voltage at node 51 |
| N0 | 0 | 0 | 0 | 0 | $0/15(V_A-V_B)$ |
| N1 | 0 | 0 | 0 | 1 | $1/15(V_A-V_B)$ |
| N2 | 0 | 0 | 1 | 1 | $2/15(V_A-V_B)$ |
| N3 | 0 | 0 | 1 | 0 | $3/15(V_A-V_B)$ |
| N4 | 0 | 1 | 1 | 0 | $4/15(V_A-V_B)$ |
| N5 | 0 | 1 | 1 | 1 | $5/15(V_A-V_B)$ |
| N6 | 0 | 1 | 0 | 1 | $6/15(V_A-V_B)$ |
| N7 | 0 | 1 | 0 | 0 | $7/15(V_A-V_B)$ |
| N8 | 1 | 1 | 0 | 0 | $8/15(V_A-V_B)$ |
| N9 | 1 | 1 | 0 | 1 | $9/15(V_A-V_B)$ |
| N10 | 1 | 1 | 1 | 1 | $10/15(V_A-V_B)$ |
| N11 | 1 | 1 | 1 | 0 | $11/15(V_A-V_B)$ |
| N12 | 1 | 0 | 1 | 0 | $12/15(V_A-V_B)$ |
| N13 | 1 | 0 | 1 | 1 | $13/15(V_A-V_B)$ |
| N14 | 1 | 0 | 0 | 1 | $14/15(V_A-V_B)$ |
| N15 | 1 | 0 | 0 | 0 | $15/15(V_A-V_B)$ |

The control signals S0, S1, S2, and S3 can respectively adjust voltage by units of $(V_A-V_B)/15$, $2\times(V_A-V_B)/15$, $4\times(V_A-V_B)/15$, and $8\times(V_A-V_B)/15$. The control signals S0 through S3 represent these units from lower to higher bits in this order. Further, any two code words represented by the combinations of the values in the control signals S0 through S3 have the Hamming distance 1 for neighboring nodes.

For example, in order for the voltage $3/15(V_A-V_B)$ at node N3 to be selected for the reference voltage, the values of the control signals are S3=S2=S0=0 and S1=1. Then, in order for the voltage $2/15(V_A-V_B)$ at node N2, which is lower than the voltage at node N3 by the unit of $1/15(V_A-V_B)$, to be selected, only the value of S0 has to be changed from 0 to 1 in the code word for node N3. Also, in order for the voltage $4/15(V_A-V_B)$ at node N4, which is higher than the voltage at node N3 by the unit of $1/15(V_A-V_B)$, only the value of S2 has to be changed from 0 to 1 in the code word for node N3. In this way, one and only one of the values in the control signals is to be changed between the voltages at any neighboring nodes.

In the case of FIG. 1, the signal lines for control signals S3 and S2 are respectively connected to the power supply lines GND and Vcc, so that the values of the control signals S3 and S2 respectively become 0 and 1. Further, the signal lines for control signals S1 and S0 are respectively connected to fuse circuits 295 and 294. Therefore, by Table 3, the selection of the reference voltage is possible within the range of the voltages at nodes N4 through N7.

As described above, in the present embodiment, the control signals in the control circuit consist of the part determined by the fuse circuits and the part determined by a fixed voltage supplied through fixed wiring lines, such as power supply lines, that provide a predetermined constant voltage. Therefore, the use of fuse circuits can be reduced, so that time for disconnecting fuses can be shortened. Further, the area of the whole control circuit can be reduced as a result of changing a part of fuse circuits into predetermined fixed wiring lines.

The selection range for the reference voltage becomes narrower by reducing fuse circuits. However, analysis of the dispersion occurring in actual manufacturing indicates that it is more important to be able to adjust voltage finely within a particular range than to be able to adjust in a wide range.

As described above, in the present embodiment, construction of the selecting circuit is made to distinguish the nearest voltages represented by the code words of the control signals by the Hamming distance 1. Then the construction is made to be able to change the values of the lower bits, which are represented by control signals S1 and S0 and require fine adjustment, continuously by fuse circuits and to fix the values of the upper bits, which are represented by the control signals S3 and S2, by fixed wiring lines.

At early stages of development where dispersion is great, a method that uses only fuse circuits and allows fine adjustment over the whole range as in the prior example may be better. However, when technology of manufacturing the semiconductor is settled comparatively stable, dispersion in the reference voltage is constrained. Therefore, in such a stage, a method such as the present embodiment that uses fuse circuits and fixed wiring lines predetermined in the manufacturing process to adjust finely within a constant range is appropriate.

Therefore, a great number of fulses may be used at early stages of development, and the ratio of fuse circuits may be reduced when manufacturing technology becomes stable.

Further, a fuse circuit may be built for each control signal, and fuse circuits and fixed wiring lines may be used depending on the stability of manufacturing technology. In this case the area for fuse circuits cannot be reduced, but the degree of freedom in the control signals can be changed depending on the stability of manufacturing technology, so that time for disconnecting fuses can be reduced when manufacturing is settled stable.

Further, in FIG. 1, the output signals F1 of the fuse circuits are used, but the output signals F2 of the fuse circuits may be used. If the node voltage of the greatest frequency can be found in the manufacturing process, one of F1 and F2 can be selected and wiring is established so that the corresponding values of the control signals can be obtained without disconnecting any fuse. In that case, disconnection of fuses become unnecessary in a great number of chips, so that time for disconnecting fuses is further shortened.

Therefore, a circuit in which a pair of complementary signals can be selected as the output signals of the fuse circuits is effective in shortening the time to disconnect fuses.

We described, as a prior example, an example such that the node from which the reference voltage is output is connected to buffer circuit 92. In FIG. 1 for the present embodiment, the node 51 from which the reference voltage is output is not connected to any definite circuit. However, the node 51 may be connected to any circuit that uses the reference voltage.

Second Embodiment

Figure 4:
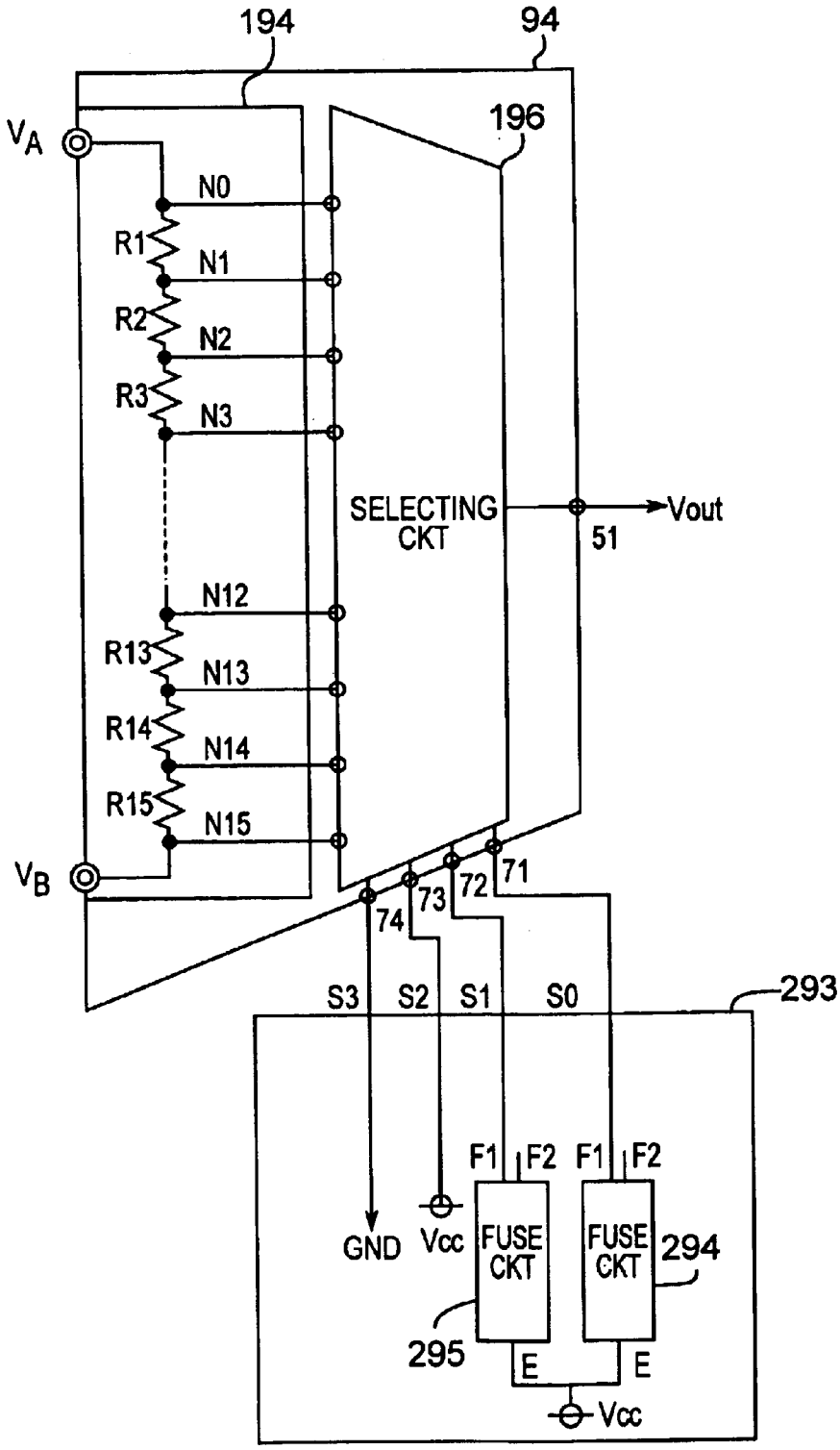
FIG. 4 illustrates a reference-voltage generating circuit in a second embodiment of the present invention.
Figure 5:
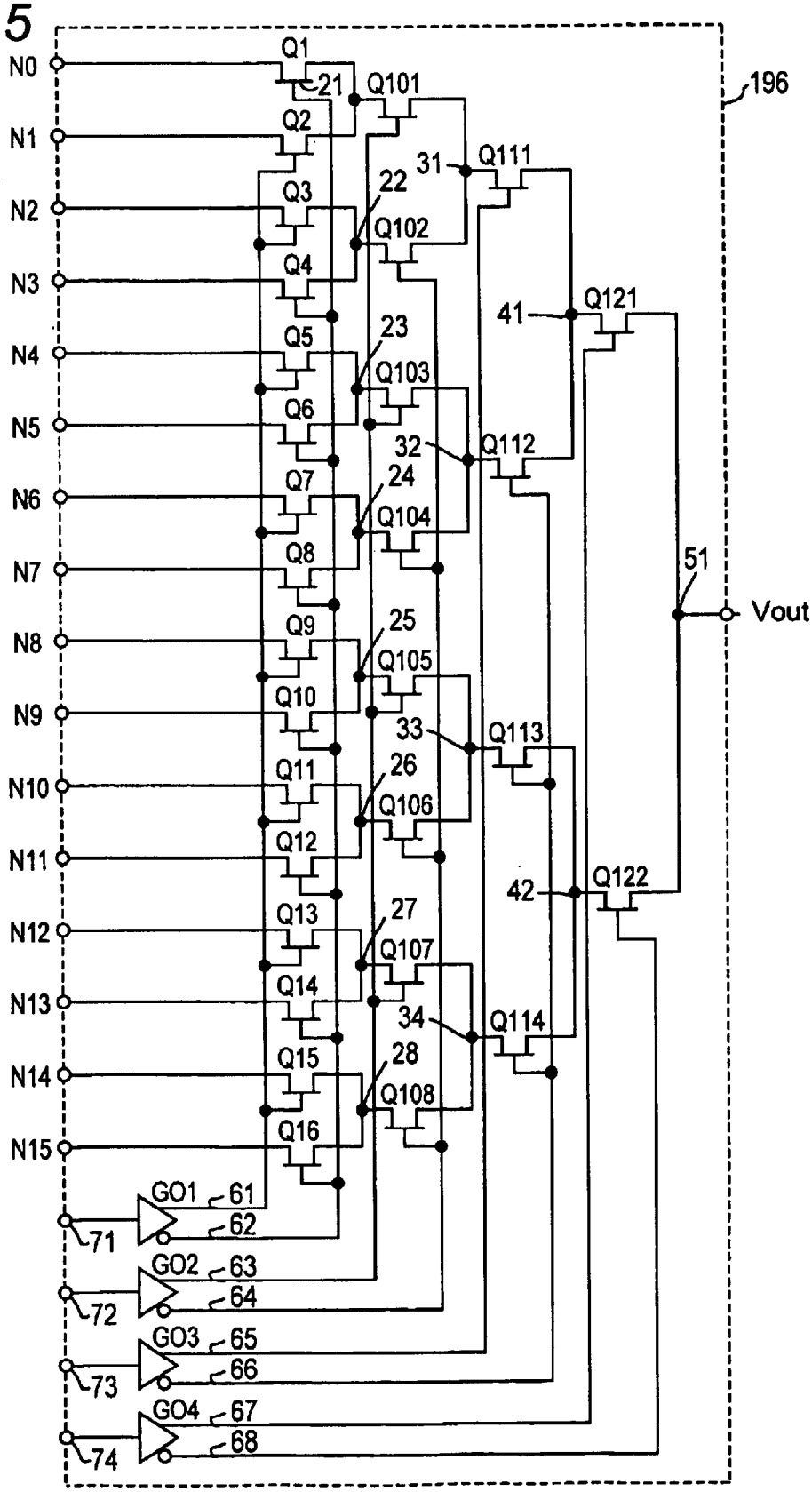
FIG. 5 illustrates a selecting circuit in the second embodiment of the present invention.

FIG. 4 illustrates the reference-voltage generating circuit in a second embodiment. The second embodiment differs from the first embodiment illustrated in FIG. 1 in that the selecting circuit 195 is now denoted by 196. The selecting circuit 196 illustrated in FIG. 5 differs from the selecting circuit 195 illustrated in FIG. 3 in that connections between the n-channel MOSFET Q1 through Q16, Q101 through Q108, Q111 through Q114, Q121 and Q122, and the buffer G01 through G04 are different.

The selecting circuit 195 in FIG. 1 was constructed, as seen from Table 3, so that the nearest voltages can be represented by the code words having the hamming distance 1. In contrast, the selecting circuit 196 is constructed, as shown in Table 4, so that the code words represented by the control signals S0 through S3 can be the members of the binary-coded decimal code such that the represented decimal numbers increase one by one as the reference voltage rises.

TABLE 4

| | Binary-coded decimal | | | | |
|---|---|---|---|---|---|
| ry number | Control signals | | | | Reference Voltage |
| Node | S3 | S2 | S1 | S0 | Voltage at node 51 |
| N0 | 0 | 0 | 0 | 0 | $0/15(V_A-V_B)$ |
| N1 | 0 | 0 | 0 | 1 | $1/15(V_A-V_B)$ |
| N2 | 0 | 0 | 1 | 0 | $2/15(V_A-V_B)$ |
| N3 | 0 | 0 | 1 | 1 | $3/15(V_A-V_B)$ |
| N4 | 0 | 1 | 0 | 0 | $4/15(V_A-V_B)$ |
| N5 | 0 | 1 | 0 | 1 | $5/15(V_A-V_B)$ |
| N6 | 0 | 1 | 1 | 0 | $6/15(V_A-V_B)$ |
| N7 | 0 | 1 | 1 | 1 | $7/15(V_A-V_B)$ |
| N8 | 1 | 0 | 0 | 0 | $8/15(V_A-V_B)$ |
| N9 | 1 | 0 | 0 | 1 | $9/15(V_A-V_B)$ |
| N10 | 1 | 0 | 1 | 0 | $10/15(V_A-V_B)$ |
| N11 | 1 | 0 | 1 | 1 | $11/15(V_A-V_B)$ |
| N12 | 1 | 1 | 0 | 0 | $12/15(V_A-V_B)$ |
| N13 | 1 | 1 | 0 | 1 | $13/15(V_A-V_B)$ |
| N14 | 1 | 1 | 1 | 0 | $14/15(V_A-V_B)$ |
| N15 | 1 | 1 | 1 | 1 | $15/15(V_A-V_B)$ |

In the prior example, the values of the control signals were determined by two measurements. Therefore, the construction such that the Hamming distance between two code words for the closest voltages is 1 was appropriate. However, in the case where the values of the control signals are determined by only one measurement, the binary-coded decimal code is not inappropriate. For example, in FIG. 4, the value of the control signals S3 and S2 are respectively 0 and 1, and one of the continuous voltages at nodes N4 through N7 in a constant range can be selected. This selection can be made by the control signals S0 and S1 through a measurement and the like.

In this way, even if we use the selecting circuit 196 that uses the binary-coded decimal code, we can set an appropriate reference voltage if it is limited within a fixed voltage range. In particular, in the case of dispersion being within a small fixed voltage range, the present embodiment is effective when part of lower bits that finely adjust minute voltage is associated with fuse circuits, and the other part of upper bits that adjust greater voltage than the lower bits is associated with fixed wiring lines.

Further, the binary-coded decimal code orderly changes, so that the present embodiment has an advantage that the judgment for disconnecting fuses can be made easily.

Third Embodiment

Figure 6:
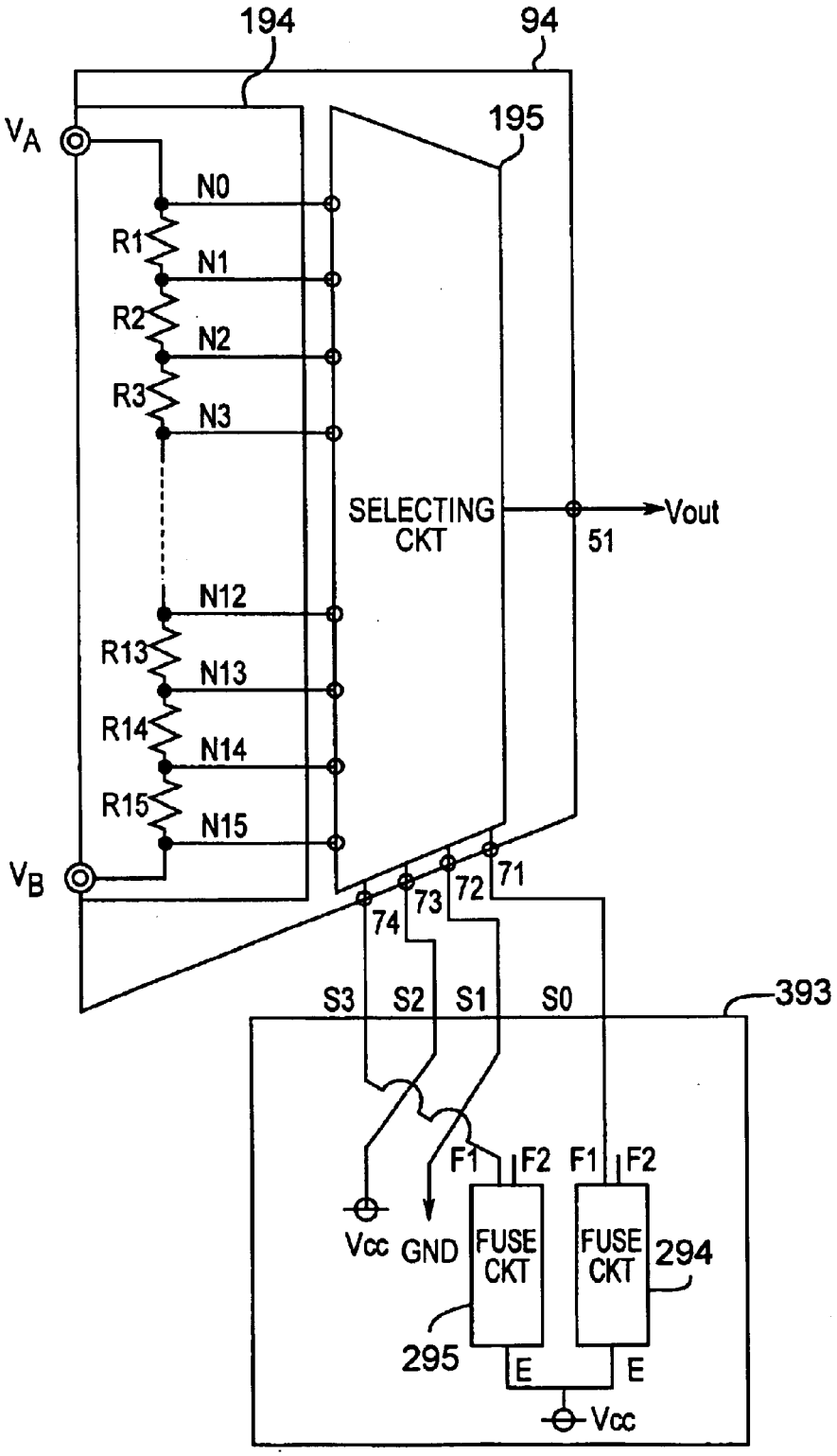
FIG. 6 illustrates a reference-voltage generating circuit in a third embodiment of the present invention.

FIG. 6 illustrates a reference-voltage generating circuit in a third embodiment. FIG. 6 differs from FIG. 1, which illustrates the reference-voltage generating circuit in the first embodiment, in that the control circuit 193 is changed to 393. Also, in FIG. 6, the control signals S1 and S2 are respectively connected to the GND wiring line (0 as data) and the Vcc line (1 as data) as the part determined beforehand by masks used in the wiring process of semiconductor manufacturing.

Also, the control signals S0 and S3 are connected to fuse circuits 294 and 295 as the adjustable part determined by fuse circuits, depending on whether fuses are disconnected or not. In this case, the reference voltage can be selected within the range of voltages at nodes N6 through N9 before fuses are disconnected.

The present embodiment is effective in the following cases. It may be found from the average of chips that dispersion of voltage is centered at the voltage at node N7 in Table 3. In this case, in the first embodiment illustrated by FIG. 1, the voltage at node N8, which is one-level higher than the voltage at node N7, cannot be selected by the adjustment of the control signals S0 and S1, as seen from Table 3. In contrast, in the present embodiment, the values of the control signals S2 and S1, which do not change immediately below and above the voltage at node N7, are determined beforehand by wiring, as seen from Table 3. Then the values of the control signals S3 and S0 are determined by fuse circuits 294 and 295. Therefore, the present embodiment can accommodate the case where voltage is dispersed around the voltage at node N7.

In particular, the present embodiment is excellent in the point that voltage can be set around a central value by changes in the connections of wiring lines in control circuit 393 without altering the selecting circuit in the case where the number of control signals that use fuse circuits is limited.

In this way, it is effective to use fuse circuits by an appropriate combination of upper and lower bits, instead of using fuse circuits for only lower bits of control signals, depending on the target reference voltage, so that the voltage immediately below and above the target voltage can be selected.

Fourth Embodiment

Figure 7:
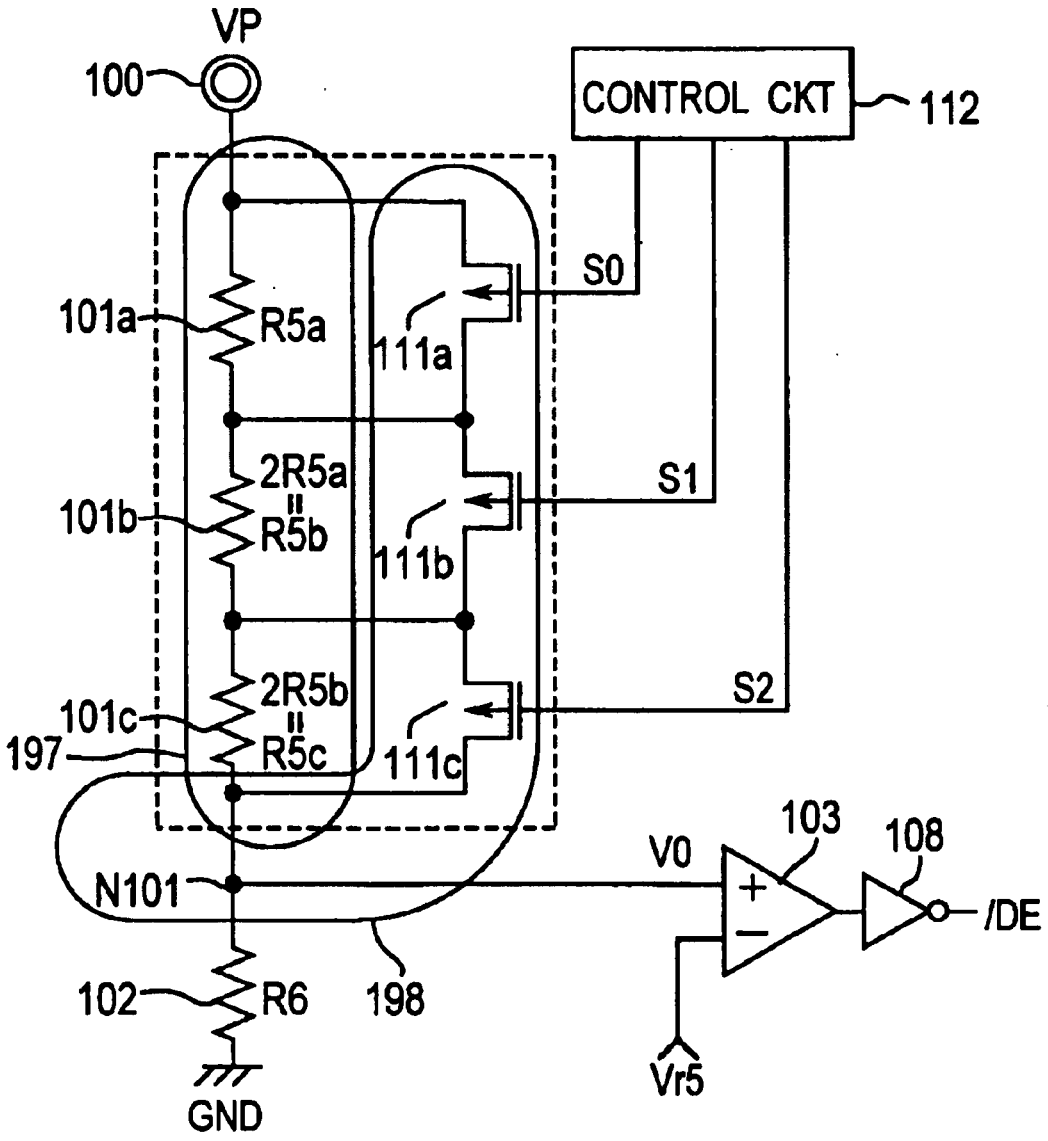
FIG. 7 illustrates a high-voltage detecting circuit in a fourth embodiment of the present invention.

FIG. 7 illustrates a high-voltage detecting circuit for high voltage more than the source voltage in a fourth embodiment.

Reference numeral 100 is a VP wiring line through which a high voltage VP from a high-voltage generating circuit (not illustrated) is output. Between the VP wiring line and a power supply line GND, a divided-voltage generating circuit 197 and a resistor 102 of resistance R6 are connected in series, and a detected voltage is output from a node N101, which is the connection node between divided-voltage generating circuit 197 and resistor 102. The divided-voltage generating circuit 197 consists of resistors 101*a* through 101*c* connected in series, whose resistances are respectively R5*a*, R5*b*, and R5*c*. Here relations between the resistances are R5*b*=2·R5*a* and R5*c*=2·R5*b*.

The node N101 is connected to one input terminal of a comparator 103, and a predetermined voltage Vr5 is input to the other terminal of comparator 103. The output of comparator 103 is output as an output signal/DE through an inverter 108 and works as a signal for controlling the high-voltage generating circuit.

Further, a selecting circuit 198 is connected to divided-voltage generating circuit 197, and controlled by control signals S0 through S2 of a control circuit 112. The selecting circuit 198 controls whether current can flow through the resistors of divided-voltage generating circuit 197. In other words, the end of each resistor of divided-voltage 197 outputs one of the outputs of divided-voltage generating circuit 197, and selecting circuit 198 selects one of these outputs and takes it out to node N101, depending on the control signals.

Reference numerals 111*a* through 111*c* are p-channel MOS transistors, and each gate is controlled by the control signals from control circuit 112. For example, if the value of the control signal is 0, then current flows through p-channel transistor 111*a* and flows very little through 101*a*, so that the electric potentials of the two ends of resistor 101*a* become almost the same.

Conversely, if the value of the control signal S0 is 1, current does not flow through p-channel transistor 111*a* and flows only through resistor 101*a*, so that a potential difference, which is the product of the resistance R5*a* and the current, is generated between the two ends of resistor 101*a*.

Table 5 shows the resistances, which are adjustable by the control signals, between nodes N100 and N101. The values are represented in units of the resistance R5*a* and can be varied from 0 to 7×R5*a*.

The control circuit 112 used in the present embodiment is constructed by removing the control signal S3 and the section related to it from the control circuit 193 illustrated in FIG. 1. When the control signal S3 and the section related to it are removed from the control circuit 193, we have S2=Vcc, and S0 and S1 are determined by fuse circuits 294 and 295. Therefore, one of the resistances 0 through 3×R5*a* can be selected in Table 5. A current corresponding to this resistance flows through divided-voltage generating circuit 197, and a corresponding voltage is output from node

TABLE 5

| Resistance of divided-voltage generating circuit | Control signals S2 | S1 | S0 |
|---|---|---|---|
| 0 | 1 | 1 | 1 |
| 1xR5a | 1 | 1 | 0 |
| 2xR5a | 1 | 0 | 1 |
| 3xR5a | 1 | 0 | 0 |
| 4xR5a | 0 | 1 | 1 |
| 5xR5a | 0 | 1 | 0 |
| 6xR5a | 0 | 0 | 1 |
| 7xR5a | 0 | 0 | 0 |

In the divided-voltage generating circuit and the selecting circuit constructed as above, the resistances of the resistors connected between the p-channel transistors, which become switches controlled by the control signals, are not the same but weighted with integral ratios here, so that the number of bits, which is the number of the control signals, is reduced.

Specifically, in the case where the two resistors of resistances R5*a* and 2R5*a* are connected in series, one of R5*a*, 2×R5*a*, and 3×R5*a* can be set. However, in the case where three resistors of resistance R5*a* are connected in series, similar resistance cannot be set, unless three control signals are available.

In this way, by giving ratios between the resistances, the number of bits in the control signals can be reduced by 1. The ratios between the resistances are not necessarily limited to integers. Ratios less than 1 are good for fine adjustment.

Further, if we generate part of control signals by fixed wiring, then we can decrease the number of fuse circuits and the fuse area. In this case, if we connect the control signal lines for upper bits that control resistors of large resistance to fixed wiring lines and connect the control signal lines for lower bits to fuse circuits, we can finely adjust the voltage.

The present embodiment illustrated in FIG. 7 does not directly detect the high voltage VP that has been generated in the high-voltage generating circuit. Instead, the present embodiment takes out the voltage obtained from the voltage VP by the divided-voltage generating circuit 197 and the resistor 102. The comparator 103 then determines whether that voltage is desired or not and feed the determined result back to the high-voltage generating circuit as the signal/DE.

Therefore, there is no need of arranging a great number of fuse circuits to finely adjust voltage in a wide range, so that the present embodiment is excellent in being able to perform fine adjustment.

In the present embodiment, we have described the case where the voltage to be adjusted is assumed to be greater than the power supply voltage, because adjustment of high voltage is usually difficult to achieve. However, the present embodiment is also effective for a voltage below the power supply voltage.

Further, in flash memory and the like, there are cases where a plurality of high voltages are used. In these cases, the constructions of using weighted resistances and taking out partial voltage can reduce the circuit area for each voltage and is effective in reducing the number of fuses.

Fifth Embodiment.

Figure 8:
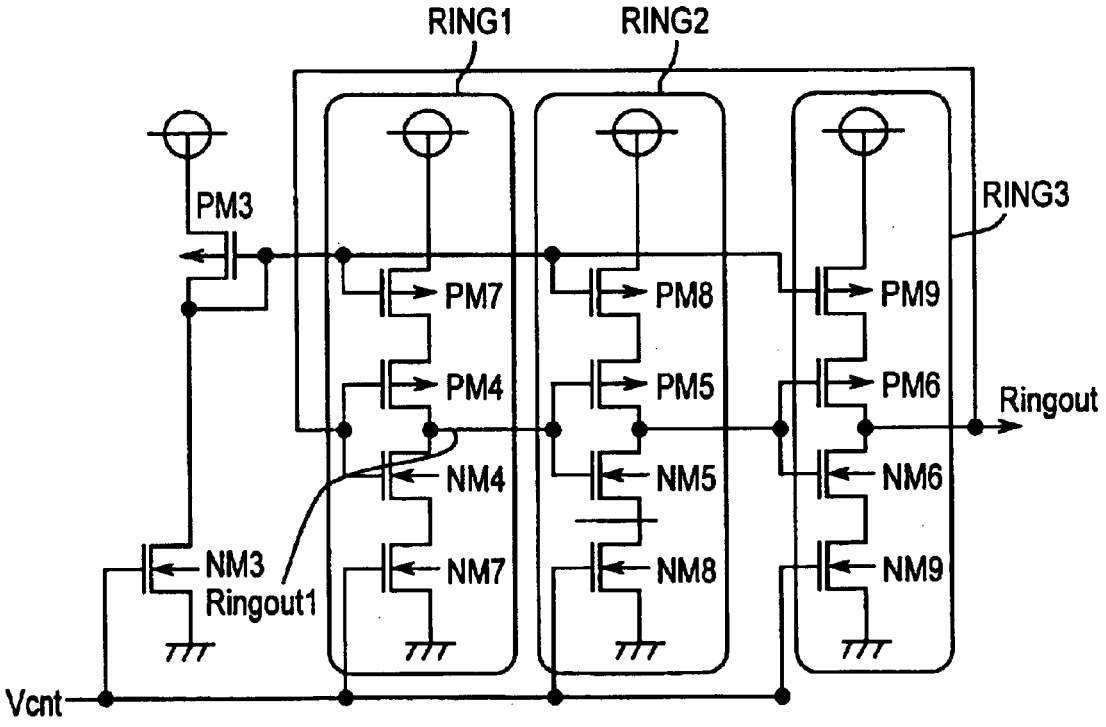
FIG. 8 illustrates a voltage-control oscillator circuit in a fifth embodiment.
Figure 9:
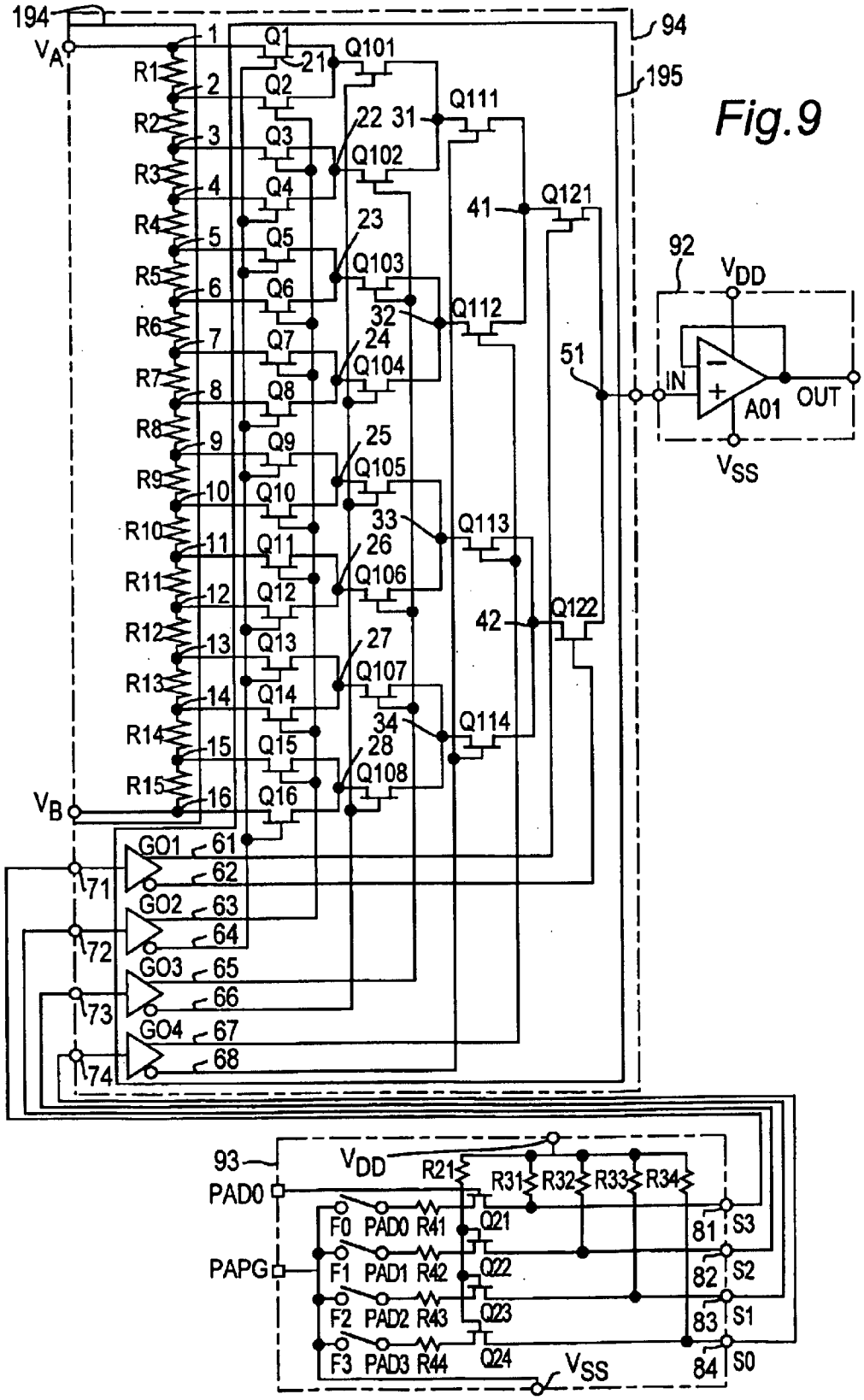
FIG. 9 illustrates a prior reference-voltage generating circuit.

FIG. 8 illustrates a voltage-control oscillator circuit in a fifth embodiment. This voltage-control oscillator circuit receives, for example, the output Vout of the reference-voltage generating circuit in FIG. 1 and outputs an oscillation signal Ringout.

In FIG. 8, PM3 through PM9 are p-type MOS transistors, and NM3 through NM9 are n-type MOS transistors. RING1 through RING3 constitute a ring oscillator with odd steps of inverters, and each step outputs an inverted signal of an input signal. For example, the input signal is Ringout and the output signal is Ringout1.

Further, the circuit composed of PM3 and NM3 operates so that the gate voltage of PM7 through PM9 can decline as the reference voltage Vout rises, and the reference voltage Vout is input to the gates of NM7 through NM9. By this means, the voltage at each step is adjusted depending on the reference voltage Vout, so that a large amount of current flows when the reference voltage is high, and a small amount of current flows when the reference voltage is low. Therefore, when the reference voltage Vout is high, the oscillation frequency of the oscillation signal Ringout becomes high, and when the reference voltage Vout is low, the oscillation frequency of the oscillation signal becomes low.

In the voltage-control oscillator circuit constructed as above, the oscillation frequency can be adjusted by the control circuit 193 and others illustrated in FIG. 1.

In the first to fifth embodiments, the number of bits in the control signals is 4 bits in total, but similar constructions can be similarly made so that the number of bits can be any number.

The reference-voltage generating circuit in the present invention can be applied to memories such as DRAM, SRAM, flash memory and the like. However, for flash memory in particular, high voltage is required for operation, so that the high-voltage detecting circuit as described in the fourth embodiment is useful.

Although the present invention has been described in connection with the preferred embodiments thereof with reference to the accompanying drawings, it is to be noted that various changes and modifications are apparent to those skilled in the art. Such changes and modifications are to be understood as included within the scope of the present invention as defined by the appended claims, unless they depart therefrom.

What is claimed is:

1. A semiconductor device which comprises:

a control circuit that is connected to wiring lines that supply a predetermined voltage and outputs a first control signal depending on said predetermined voltage and a second control signal that can be set depending on whether a fuse is disconnected or not;

a divided-voltage generating circuit that is connected between predetermined first and second potential points and outputs voltages set between the two potentials at constant voltage intervals; and a selecting circuit constructed so that the distance between any code words of said first and second control signals representing the two closest voltages is the Hamming distance for neighboring wiring lines, said selecting circuit selecting as a reference voltage one of the voltages output from said divided-voltage generating circuit by adjusting setting of said second control signal.

2. The semiconductor device defined in claim 1, wherein the control signals of said control circuit consist of a group of lower bits that can adjust minute voltage and a group of upper bits that can control voltages greater than the one that said group of lower bits can adjust, and said first control signal is one bit of said group of lower bits and said second control signal is one bit of said group of upper bits.

* * * * *

UNITED STATES PATENT AND TRADEMARK OFFICE

CERTIFICATE OF CORRECTION

PATENT NO. : 6,774,703 B2
DATED : August 10, 2004
INVENTOR(S) : Mihara, Masaaki

It is certified that error appears in the above-identified patent and that said Letters Patent is hereby corrected as shown below:

Column 12,
Line 4, change "distance for" to -- distance 1 for --.

Signed and Sealed this

Thirty-first Day of May, 2005

JON W. DUDAS
*Director of the United States Patent and Trademark Office*